US009359706B2

(12) United States Patent
Lundbom

(10) Patent No.: US 9,359,706 B2
(45) Date of Patent: Jun. 7, 2016

(54) FIRE CONTAINMENT SYSTEM FOR VENTED CLOTHES DRYER APPLIANCE

(71) Applicant: WNL Inc., Clackamas, OR (US)

(72) Inventor: Lawrence R. Lundbom, Clackamas, OR (US)

(73) Assignee: WNL Inc., Clackamas, OR (US)

( * ) Notice: Subject to any disclaimer, the term of this patent is extended or adjusted under 35 U.S.C. 154(b) by 97 days.

(21) Appl. No.: 14/523,748

(22) Filed: Oct. 24, 2014

(65) Prior Publication Data

US 2016/0115634 A1 Apr. 28, 2016

(51) Int. Cl.

| | |
|---|---|
| ***D06F 37/42*** | (2006.01) |
| ***D06F 35/00*** | (2006.01) |
| ***D06F 58/28*** | (2006.01) |
| ***D06F 29/02*** | (2006.01) |
| ***D06F 39/08*** | (2006.01) |
| ***D06F 58/20*** | (2006.01) |
| *D06F 25/00* | (2006.01) |

(52) U.S. Cl.

CPC ..... *D06F 37/42* (2013.01); *D06F 29/02* (2013.01); *D06F 35/00* (2013.01); *D06F 39/088* (2013.01); *D06F 58/20* (2013.01); *D06F 58/28* (2013.01); *D06F 25/00* (2013.01); *D06F 2058/2858* (2013.01)

(58) Field of Classification Search

CPC ..... D06F 37/42; D06F 58/20; D06F 58/28; D06F 2058/2858; D06F 25/00; D06F 35/00; F26B 25/009

See application file for complete search history.

(56) References Cited

U.S. PATENT DOCUMENTS

| | | | | |
|---|---|---|---|---|
| 5,396,715 | A * | 3/1995 | Smith | D06F 58/266 219/710 |
| 6,505,418 | B1 * | 1/2003 | Confoey | D06F 58/263 34/260 |
| 6,655,047 | B2 * | 12/2003 | Miller, II | D06F 58/20 34/544 |
| 6,715,216 | B1 * | 4/2004 | Salameh | D06F 58/28 34/350 |
| 7,013,577 | B2 * | 3/2006 | Kegler | D06F 58/20 34/544 |
| 2003/0010509 | A1 * | 1/2003 | Hoffman | A62C 3/04 169/56 |
| 2010/0175898 | A1 * | 7/2010 | Steinicke | A62C 3/00 169/46 |
| 2013/0139404 | A1 * | 6/2013 | Stegerwald | F26B 20/00 34/524 |
| 2013/0167400 | A1 * | 7/2013 | Stegerwald | A62C 3/00 34/524 |
| 2013/0174441 | A1 * | 7/2013 | Grunert | A62C 3/00 34/524 |
| 2014/0138106 | A1 * | 5/2014 | Dolton | A62C 35/10 169/58 |

FOREIGN PATENT DOCUMENTS

| | | | |
|---|---|---|---|
| EP | 2072659 | A1 | 6/2009 |
| WO | 2015092648 | A1 | 6/2015 |

* cited by examiner

*Primary Examiner* — Joseph L Perrin

(74) *Attorney, Agent, or Firm* — Stoel Rives LLP

(57) ABSTRACT

A preferred embodiment of a fire containment system is implemented in a combination washer-dryer appliance equipped with air-vented exhaust. A fire suppression fluid conduit connected between a cold water valve outlet and a fire suppression fluid inlet positioned in a top portion of a tub of the appliance provides a path of cold water flow into an interior space of the tub. A valve control signal applied to a valve actuator associated with the cold water valve outlet actuates it upon a presumed occurrence of presence of fire in the interior space, as indicated by an electromechanical switch set in the top portion of the tub to measure an internal temperature of the interior space. The valve control signal thereby causes cold water flow through the fire suppression fluid conduit and into the interior space of the tub to contain and extinguish a fire burning within it.

19 Claims, 3 Drawing Sheets

FIRE CONTAINMENT SYSTEM FOR VENTED CLOTHES DRYER APPLIANCE

COPYRIGHT NOTICE

©2014 WNL Inc. A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR §1.71(d).

TECHNICAL FIELD

This disclosure relates to fire containment systems for use in household or commercial appliances and, in particular, to a fire containment system for a vented clothes dryer appliance.

BACKGROUND INFORMATION

A combination clothes washer-dryer appliance is especially suitable for installation and use in tightly confined living spaces such as those in motor homes, yachts, recreation vehicles, and condominiums. Combination washer-dryer appliances are available with either a non-vented condenser dryer or a vented dryer.

A combination washer-non-vented condenser dryer has a closed outer tub constructed with a sealed separate condenser section to enable a drying process. A wash load of clothes is contained in an inner tub or basket that is mounted for rotation inside the outer tub. An air-circulating fan draws air internally from the rear of the outer tub, passes the air over a heating element of a heater box assembly attached to the top of the outer tub, and returns the heated air to the front of the outer tub by way of an inlet through a door seal. Warm air travels through and collects moisture from a wash load tumbling in the basket as it rotates. The hot, moist air extracted from the wash load travels through the condenser section where a cold water stream, at a typical rate of 2 gal/hour (7.57 l/hr), condenses the moisture into water. The water is then pumped out of the appliance through its water discharge hose. Relatively dry air is then drawn back over the heating element to repeat the process. The air-circulating fan, a one shot cut-out or thermal fuse cable, and a thermistor located in the heater box assembly control the air temperature.

A combination washer-vented dryer performs a drying process by means of a water-sealed outer tub, with an exhaust outlet located above a washing high water operating level and at the rear of the outer tub. Outside air enters beneath a blower assembly and is passed over a heating element encased in a cast aluminum heater housing attached to the top of the outer tub. Forced air developed by the blower assembly enters the front of the outer tub through an inlet opening in a door seal. Air circulates through a wash load tumbling in the basket as it rotates inside the outer tub. Moisture-carrying air extracted from the wash load exits the outer tub through an exhaust outlet pipe.

Clothes dryer appliances sold in the United States must meet the UL 2158 Dryer Fire Containment Standard, which entails passing four fire containment tests including static tumbler (drum load fire), dynamic tumbler (drum load fire), static tumbler (base lint fire), and dynamic tumbler (base lint fire) tests. Meeting this UL standard is particularly challenging for vented dryer appliances because they do not operate with a closed air system.

What is needed, therefore, is a fire containment system for vented clothes dryer appliances. What is especially needed is a fire containment system that can be implemented in a commercially available combination clothes washer-vented dryer appliance with minimal structural changes to it.

SUMMARY OF THE DISCLOSURE

A preferred embodiment of a fire containment system is implemented in a combination washer-dryer appliance equipped with air-vented exhaust. The fire containment system causes cold water flow through a fire suppression fluid conduit and into an interior space of a tub of the appliance to contain and extinguish a fire burning within the interior space.

The appliance includes a cold water inlet in fluid communication with multiple cold water valve outlets to which different ones of valve actuators are associated. The multiple cold water valve outlets are configured for selective delivery of cold water along associated conduits to the interior space of the tub and are actuatable in response to valve control signals applied to associated ones of the valve actuators.

The fire suppression fluid conduit is connected between one of the multiple cold water valve outlets and a fire suppression fluid inlet positioned in a top portion of the tub to provide a path of cold water flow into the interior space of the tub. A preferred fire suppression fluid conduit is a flexible water hose.

A water-resistant electromechanical switch is set in an aperture formed in and positioned in the top portion of the tub. The electromechanical switch has a heat sensitive surface and is secured in a fluid-tight seal to the tub so that the heat sensitive surface is exposed to the interior of the tub to measure an internal temperature in the interior of the tub. The electromechanical switch has electrical conductors for providing first and second switching states that indicate respective first and second electrical conduction conditions of the electromechanical switch, and the electromechanical switch is characterized by upper and lower temperature thresholds. The first electrical conduction condition represents a presumed presence of fire in the interior space of the tub and is developed in response to a rise in the measured internal temperature above the upper temperature threshold and to a subsequent fall in the measured internal temperature to the lower temperature threshold. The second electrical conduction condition represents a presumed absence of fire in the interior space of the tub and is developed in response to the measured internal temperature when it is below the lower temperature threshold.

A valve control signal applied to the valve actuator associated with the one of the multiple cold water valve outlets connected to the fire suppression fluid inlet actuates the one cold water valve outlet upon occurrence of the first switching state of the electromechanical switch. The valve control signal thereby causes cold water flow through the fire suppression fluid conduit and into the interior space of the tub to contain and extinguish a fire burning within the interior space.

An alternative preferred embodiment of a fire containment system is implemented in a steam-injected dryer appliance. This can be done by actuating cold water flow not to produce steam as intended for use in a normal drying cycle but instead in response to a thermostat measurement of temperature indicating a presumed presence of fire burning within the interior space of the tub.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
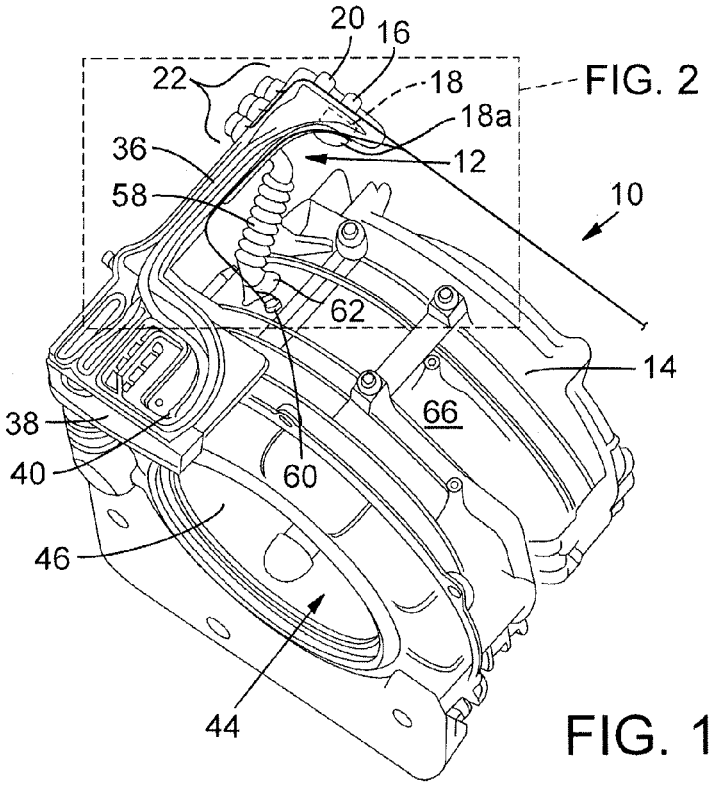
FIG. 1 is a fragmentary isometric view of the major structural and water delivery system components of a combination washer-vented dryer appliance with its outer cover removed and equipped with the disclosed water delivery-based fire containment system.
Figure 2:
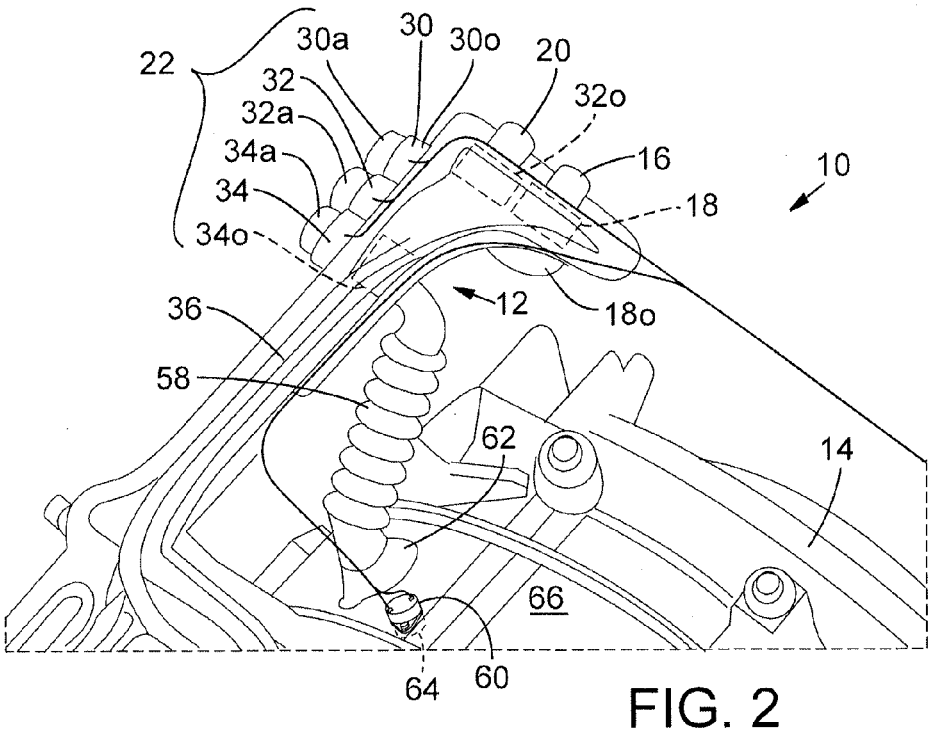
FIG. 2 is an enlarged fragmentary view of the structural and water delivery system components contained within the dashed line rectangle superimposed on FIG. 1.
Figure 3:
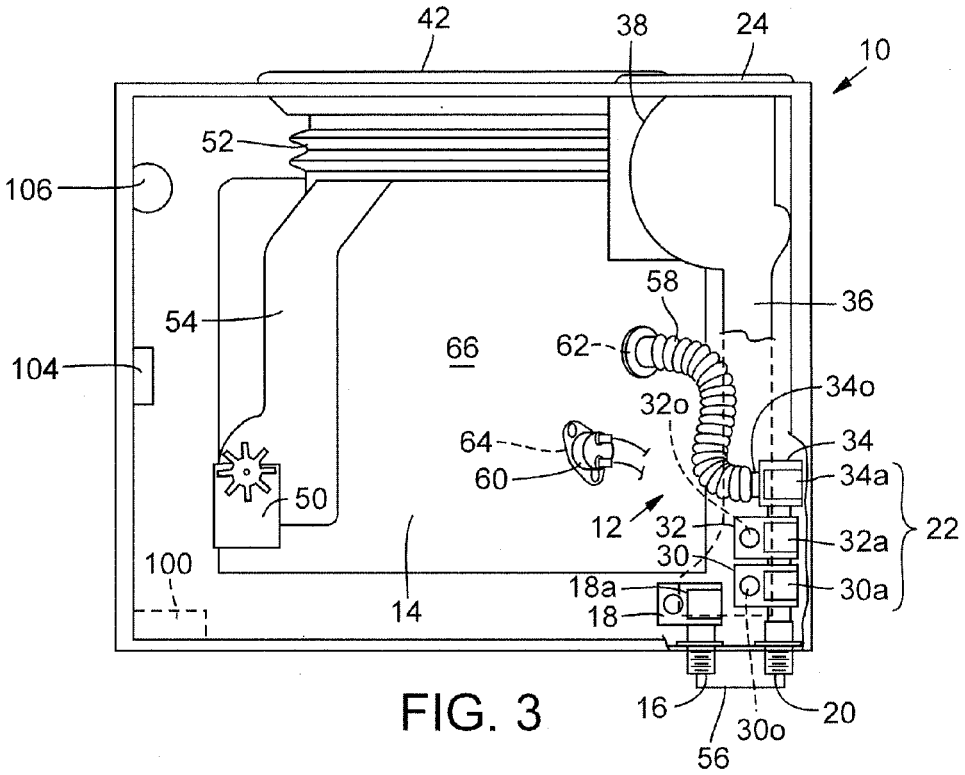
FIGS. 3 and 4 are respective plan and perspective views of the appliance of FIG. 1 shown with its outer cover in place but with its top cover removed.
Figure 4:
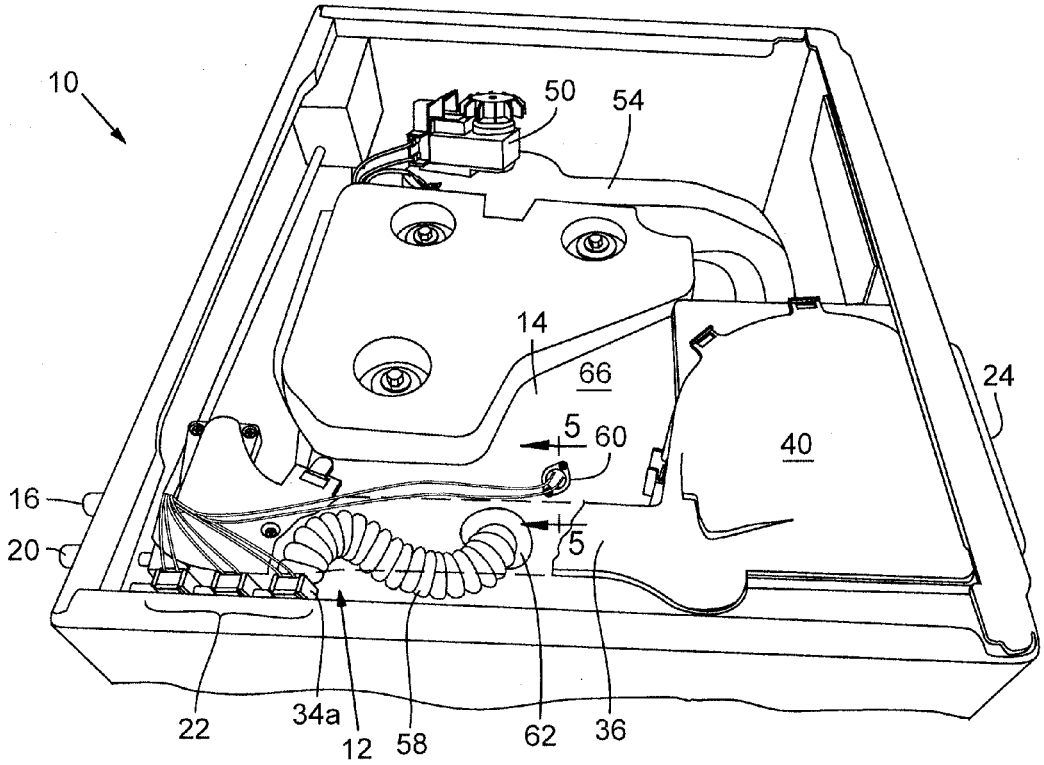

FIG. 1 shows the major structural and water delivery system components of a combination washer-vented dryer appliance 10 equipped with a water delivery-based fire suppression or containment system 12. FIG. 2 is an enlarged fragmentary view of the structural and water delivery system components of appliance 10 contained within the dashed line rectangle superimposed on FIG. 1. FIGS. 3 and 4 are respective plan and perspective views of appliance 10 with its top cover (not shown) removed. FIGS. 1, 2, 3, and 4 show, as a preferred platform for a washer-vented dryer appliance 10 on which fire containment system 12 is installed, a Model WD2100XCNA# front load combination washer-vented dryer, which is available from WNL Inc., dba Westland Sales, Clackamas, Oreg. The Model WD2100XCNA# uses electricity to heat the air that dries a wash load.

With reference to FIGS. 1, 2, 3, and 4, appliance 10 includes an outer tub 14, which is preferably made of a reinforced plastic composite material but could also be made of stainless steel. Outer tub 14 made of reinforced plastic composite material is preferred because it is rust free, costs less for material and construction labor, weighs less, and is more easily recyclable. Hot water is delivered to appliance 10 by a hot water hose (not shown) connected to a hookup inlet 16 of a single electromechanical actuator, preferably an electrically controlled hot water valve 18. Hot water valve 18 and its associated electric valve actuator 18*a* cooperate to selectively shut off or allow hot water flow from a valve outlet 18*o* in response to an applied valve control signal. Cold water is delivered to appliance 10 by a cold water hose (not shown) connected to a hookup inlet 20 of a group of independently operable electromechanical actuators, preferably a triple electrically controlled cold water valve 22 of unitary construction. (Triple cold water valve 22 replaces the double cold water valve installed in the Model WD2100XCNA# appliance, which has two outlets that include a fill valve outlet for delivery of cold water to fill outer tub 14 and an additive valve outlet for delivery of cold water through an additive (e.g., a fabric softener) tray 24 to outer tub 14.) Triple cold water valve 22 contains in a single housing cold water valves 30, 32, and 34 and their respective associated electric valve actuators 30*a*, 32*a*, and 34*a*. Cold water valves 30, 32, and 34 have respective valve outlets 30*o*, 32*o*, and 34*o*. Each of associated cold water valve and electric valve actuator pairs 30 and 30*a*, 32 and 32*a*, and 34 and 34*a* cooperates independently to selectively shut off or allow cold water flow from its respective one of valve outlets 30*o*, 32*o*, and 34*o* in response to an associated applied valve control signal.

Valve outlet 18*o* of hot water valve 18 and valve outlets 30*o* and 32*o* of cold water valve 22 deliver separate streams of water to corresponding separate water flow channels of a manifold 36. Hot water delivered from valve outlet 18*o* and cold water delivered from valve outlet 30*o* flow through their associated channels of manifold 36 and drop into a formed hopper 38 located at a terminus 40 of manifold 36. Cold water delivered from valve outlet 32*o* flows through its associated channel of manifold 36 to additive tray 24 and then drops into hopper 38. Manifold 36 replaces separate hoses that were used in earlier model appliances.

Appliance 10 has a wash load front door 42 through which a user accesses an interior space 44 of outer tub 14 to place in a perforated stainless steel drum or basket 46 a load of laundry to be washed and dried. Basket 46 is positioned for rotation about a horizontal axis inside outer tub 14. Basket 46 has in its bottom and side portions an array of mutually spaced apart holes 48 (FIG. 5) through which water flows from outer tub 14 to fill basket 46 and through which water drains from basket 46 into outer tub 14. Basket 46 rotates to tumble the wash load during regular wash and dry cycles. A blower assembly 50 delivers, through a sealed opening in a front flexible diaphragm 52 at front door 42, heated air produced by a heater 54 attached to the exterior surface at the top of outer tub 14. Hot air passing through the wash load in interior space 44 is vented from outer tub 14 through a rear exhaust pipe 56.

Fire containment system 12 includes a flexible, ribbed water delivery hose 58 and a water-resistant thermostat 60 that are fitted with fluid- or water-tight seals into respective apertures or holes 62 and 64 formed in an upper portion 66 of outer tub 14. Water delivery hose 58 is connected between valve outlet 34*o* of cold water valve 22 and hole 62 in outer tub 14. Valve outlet 34*o* provides to water delivery hose 58 a strong flow of fire-extinguishing cold water for discharge into outer tub 14 and basket 46 through its holes 48. Water delivery hose 58 functions as a fire suppression fluid conduit. Water delivery hose 58 is positioned at a convenient location on upper portion 66 of outer tub 14 so that water delivered from valve outlet 34*o* and flowing through water delivery hose 58 sprays directly through proximally situated holes 48 in basket 46 and into interior space 44 of outer tub 14.

Figure 5:
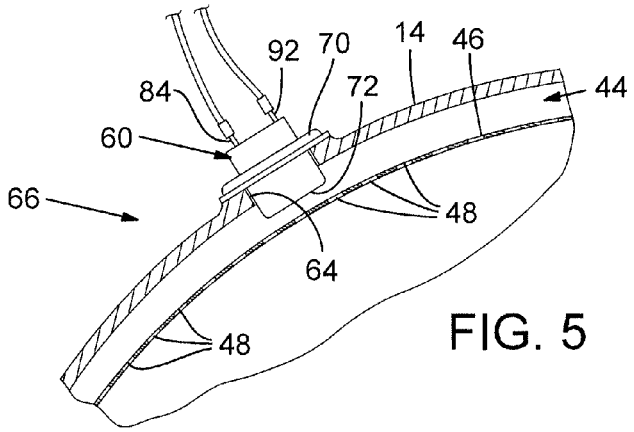
FIG. 5 is a fragmentary sectional view taken along lines 5-5 of FIG. 4.

Thermostat 60 is an electromechanical switch, preferably a bimetal disk temperature-controlled device, which is set in hole 64 formed in upper portion 66 in proximity to hole 62 where water delivery hose 58 is connected. A preferred thermostat 60 is a 36T series snap-action temperature control of a close on temperature rise type, which is available from Therm-O-Disc, Inc., Mansfield, Ohio, a wholly owned subsidiary of Emerson Electric Co., St. Louis, Mo. FIG. 5 shows the portion of preferred thermostat 60 positioned within interior space 44. As shown in FIG. 5, preferred thermostat 60 has an air stream mount in the form of a bimetal housing 70 that extends through hole 64 in upper portion 66. When thermostat 60 is set in hole 64, a heat sensitive surface 72 of housing 70 is exposed to interior space 44 of outer tub 14. Heat sensitive surface 72 detects and thereby enables measurement by thermostat 60 of the internal temperature in interior space 44 of outer tub 14. Holes 62 and 64 are spaced sufficiently far apart from each other to prevent water flowing out of water delivery hose 58 from spraying on and thereby affecting the amount of heat detected by heat sensitive surface 72 of thermostat 60.

Thermostat 60 is characterized by upper and lower temperature thresholds and produces a control signal in first and second states. The first state of the control signal is indicative of a first or closed circuit electrical conduction condition of thermostat 60. The closed circuit condition of thermostat 60 represents a presumed presence of a fire burning in basket 46 positioned in interior space 44 of outer tub 14 and is developed in response to a rise in the measured internal temperature above the upper temperature threshold and to a subsequent fall in the measured internal temperature to the lower temperature threshold. The second state of the control signal is indicative of a second or open circuit electrical conduction condition of thermostat 60. The open circuit condition of thermostat 60 represents a presumed absence of fire in basket 46 positioned in interior space 44 of outer tub 14 and is developed in response to the measured internal temperature when it is below the lower temperature threshold.

The upper temperature threshold represents a temperature set above a maximum operating temperature limit reached during a normal drying cycle of appliance 10. Setting the upper temperature threshold in this manner provides a safety factor against activating cold water flow through water delivery hose 58 during normal extreme dryer operation. The upper temperature threshold is within a temperature range of between about 90° C. and about 110° C., and preferably at about 105° C.

The lower temperature threshold represents a temperature below the upper temperature threshold by a nominal temperature differential established by thermostat 60. The reason is that the upper temperature threshold of thermostat 60 is set and the nominal temperature differential characteristic of a particular thermostat 60 establishes the lower temperature differential. A suitable thermostat 60 is, therefore, one in which the lower temperature threshold is sufficiently low to indicate cessation of a fire presumed to have been burning in interior space 44 of outer tub 14. The lower temperature threshold is within a temperature range of between about 40° C. and about 53° C., and preferably at about 50° C.

Figure 6:
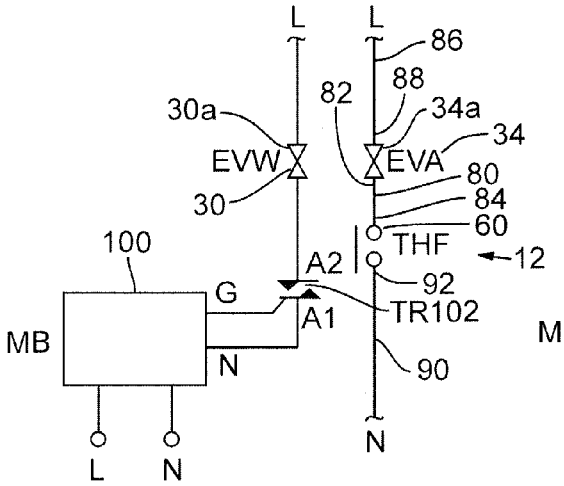
FIG. 6 is a simplified electrical circuit diagram showing the electrical connection of a thermostat to an electric valve actuator of a cold water valve that cooperate in a preferred embodiment of the disclosed fire containment system.

FIG. 6 is a simplified electrical circuit diagram showing the electrical connections to electric valve actuator 34*a* of cold water valve 34 and thermostat 60 to operate fire containment system 12. With reference to FIG. 6, a line wire terminal L and neutral wire terminal N represent power supply terminals of appliance 10, to which mains power is delivered from a grid (household) power outlet (not shown).

Electric valve actuator 34*a* and thermostat 60 are connected in electrical series, with a wire 80 connecting a terminal 82 of electric valve actuator 34*a* to a terminal 84 of thermostat 60. A wire 86 connects a terminal 88 of valve actuator 34*a* to line wire terminal L, and a wire 90 connects a terminal 92 of thermostat 60 to line wire terminal N. Thermostat 60 opens and closes the electrical circuit between wires 80 and 90 and thereby establishes the first and second states of the control signal applied to valve actuator 34*a* to control water flow from valve outlet 34*o* of cold water valve 22.

FIG. 6 shows that the operation of fire containment system 12 is separate from the regular operation of the washer-dryer functions. Therefore, as long as appliance 10 receives mains power, fire containment system 12 is operational when appliance 10 is turned off, appliance 10 is on standby, or front door 42 is open. An electronic circuit 100 mounted in appliance 10 controls its regular wash and dry cycles. Electronic circuit 100 provides a control signal to a gate terminal G of a bidirectional triode thyristor or triac 102. Triac 102 is an electronic switch that, in response to the control signal applied to gate G, provides an interruptible current signal path between terminals A1 and A2 of triac 102 to selectively energize electric valve actuator 30*a* of, and thereby selectively open and shut off, cold water fill valve 30 in the preferred washer-dryer platform for appliance 10. (Not shown in FIG. 6 is electronic circuit 100 providing a separate control signal to a triac that is connected to electric valve actuator 32*a* of cold water additive valve 32.)

Delivering the control signal in the first state to valve actuator 34*a* provides cold water flow from valve outlet 34*o*, through water delivery hose 58, and into basket 46 and outer tub 14, thereby to contain and douse a fire burning in basket 46 positioned in interior space 44 of outer tub 14. Cold water flow through water delivery hose 58 continues until thermostat 60 measures an internal temperature of interior space 44 of outer tub 14 below the lower temperature threshold, indicating that the fire is presumed to have been extinguished. An internal temperature below the lower temperature threshold causes thermostat 60 to deliver the control signal in the second state to valve actuator 34*a* to shut off water flow from valve outlet 34*o* and thereby stop discharge of water into basket 46 and outer tub 14.

Appliance 10 further comprises an overflow feature, which is standard in commercially available high-end combination washer-dryer appliances and includes a main discharge pump 104 operating in conjunction with a pressure switch (not shown). The pressure switch sends a water level signal to discharge pump 104 to actuate it and thereby cause water to drain from outer tub 14 when water filling interior space 44 reaches a predetermined high water level set by the pressure switch. Fire containment system 12 takes advantage of this overflow feature, which prevents a water overflow condition in outer tub 14 when cold water flows through water delivery hose 58 and into basket 46 and outer tub 14 to extinguish a fire burning in basket 46.

There is needed minimal modification of a prior art combination washer-vented dryer appliance to implement fire containment system 12. The modifications of appliance 10 to integrate fire containment system 12 entail only cutting holes 62 and 64 in upper portion 66 of outer tub 14, connecting water delivery hose 58 between valve outlet 34*o* of cold water valve 34 and hole 62, setting thermostat 60 in hole 64, and connecting wires 80, 86, and 90 as described above.

Figure 7:
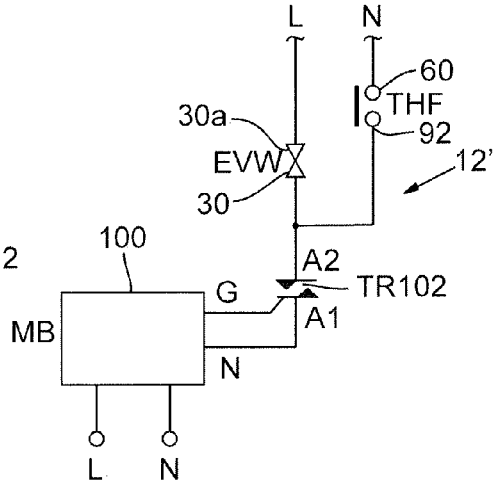
FIG. 7 is a simplified electrical circuit diagram showing, in an alternative fire containment system, an electrical connection of a thermostat to an electric valve actuator of a cold water fill valve that enables its use for regular wash cycle operation and fire containment purposes.

FIG. 7 is a simplified electrical circuit diagram showing, in an alternative fire containment system 12', an electrical connection of thermostat 54 to electric valve actuator 30*a* of cold water fill valve 30 that enables its use for regular wash cycle operation and fire containment purposes. With reference to FIG. 7, thermostat 60 in its closed circuit condition makes a direct electrical connection to neutral wire terminal N at terminal A2 of triac 102 and thereby forms an electrical connection between line wire terminal L and neutral wire terminal N. This electrical connection is formed irrespective of the state of the control signal applied to gate G of triac 102. The resultant electrical current flow path actuates electric valve actuator 30*a* to open cold water fill valve 30 for delivery of cold water flow through manifold 36 and hopper 38 and into outer tub 14.

An inherent disadvantage of fire containment system 12' is that the cold water delivered by cold water fill valve 30 is discharged from manifold 36 and into the bottom of outer tub 14, not directly from upper portion 66 of outer tub 14, through holes 48 in basket 46, and directly onto the burning clothes and fire. Water flows from inner tub 14 and into basket 46 through its holes 48 as inner tub 14 fills with water. The indirect delivery of water into basket 46 adversely impacts the effectiveness of fire containment system 12' by appreciably increasing the time for delivery of a sufficient amount of water to douse a fire in basket 46 positioned inside outer tub 14.

It will be obvious to those having skill in the art that many changes may be made to the details of the above-described embodiments without departing from the underlying principles of the invention. For example, a steam-injected dryer appliance can be configured to implement the disclosed fire containment system. This can be done by actuating cold water flow not to produce steam as intended for use in a normal drying cycle but instead in response to a thermostat measurement of temperature indicating a presumed presence of fire burning in the basket. The scope of the present invention should, therefore, be determined only by the following claims.

The invention claimed is:

1. A method of implementing a fire containment system in a combination washer-dryer appliance equipped with air-vented exhaust, the appliance including a cold water inlet in fluid communication with multiple cold water valve outlets to which different ones of valve actuators are associated, the multiple cold water valve outlets configured for selective delivery of cold water along associated conduits to an interior space of a tub and actuatable in response to valve control signals applied to associated ones of the valve actuators, the tub having a top portion, and the interior space of the tub having an opening through which a user can access the interior space to load items intended for washing, drying, or both, the method comprising:

forming a fire suppression fluid inlet to the interior space of the tub, the fire suppression fluid inlet positioned in the top portion of the tub;

connecting a fire suppression fluid conduit between one of the multiple cold water valve outlets and the fire suppression fluid inlet to provide a path of cold water flow into the interior space of the tub;

setting a water-resistant electromechanical switch in an aperture formed in and positioned in the top portion of the tub, the electromechanical switch having a heat sensitive surface and secured in a fluid-tight seal to the tub so that the heat sensitive surface is exposed to the interior of the tub to measure an internal temperature in the interior of the tub, the electromechanical switch having electrical conductors for providing first and second switching states that indicate respective first and second electrical conduction conditions of the electromechanical switch, and the electromechanical switch characterized by upper and lower temperature thresholds, the first electrical conduction condition representing a temperature indicative of fire in the interior space of the tub and developed in response to a rise in the measured internal temperature above the upper temperature threshold and to a subsequent fall in the measured internal temperature to the lower temperature threshold, and the second electrical conduction condition representing a temperature indicative of absence of fire in the interior space of the tub and developed in response to the measured internal temperature when it is below the lower temperature threshold; and producing and applying to the valve actuator associated with the one of the multiple cold water valve outlets connected to the fire suppression fluid inlet, upon occurrence of the first switching state of the electromechanical switch, the valve control signal that actuates the one of the multiple cold water valve outlets and thereby causes cold water flow through the fire suppression fluid conduit and into the interior space of the tub to contain and extinguish a fire burning within the interior space.

2. The method of claim 1, in which the multiple cold water valve outlets include three cold water valve outlets.

3. The method of claim 1, in which the multiple cold water valve outlets include three cold water valve outlets formed in a unitary structure, and in which the one of the multiple cold water valve outlets is formed in the unitary structure.

4. The method of claim 1, in which the fire suppression fluid conduit is a flexible water hose.

5. The method of claim 1, in which the electromechanical switch is a thermostat of a bimetal disk, close on temperature rise type.

6. The method of claim 1, in which the upper temperature threshold represents a temperature set above a maximum operating temperature limit reached during a normal drying cycle of the appliance.

7. The method of claim 1, in which the upper temperature threshold is set to between about 90° C. and about 110° C.

8. The method of claim 1, in which the lower temperature threshold represents a temperature below the upper temperature threshold by a nominal temperature differential established by the electromechanical switch.

9. The method of claim 1, in which the lower temperature threshold is set to between about 40° C. and about 53° C.

10. The method of claim 1, in which the first electrical conduction condition and the second electrical conduction condition represent, respectively, a closed electrical circuit and an open electrical circuit.

11. The method of claim 1, in which the appliance further comprises an overflow feature that includes a water discharge pump in operative connection to a water discharge outlet from the tub, the water discharge pump pumping water from the tub in response to water filling the interior space of the tub and reaching a predetermined high water level and thereby preventing a water overflow condition when cold water flows through the fire suppression fluid conduit and into the interior space of the tub to extinguish a fire burning within the interior space.

12. The method of claim 1, in which the conduits associated with at least two of the multiple cold water valve outlets form part of a manifold through which the cold water flows along separate channels terminating in a reservoir that drains the cold water into the interior space of the tub.

13. The method of claim 1, in which the tub is made of reinforced plastic composite material.

14. A vented clothes dryer appliance implemented with a fire containment system, comprising:

a cold water inlet in fluid communication with a cold water valve outlet to which a valve actuator is associated, the cold water valve outlet configured for selective delivery of cold water along a fluid conduit to an interior space of a tub and actuatable in response to a valve control signal applied to the valve actuator, the tub having a top portion, and the interior space of the tub having an opening through which a user can access the interior space to load items of clothing;

a water-resistant electromechanical switch set in an aperture formed in and positioned in the top portion of the tub, the electromechanical switch having a heat sensitive surface and secured in a fluid-tight seal to the tub so that the heat sensitive surface is exposed to the interior of the tub to measure an internal temperature in the interior of the tub, the electromechanical switch having electrical conductors for providing first and second switching states that indicate respective first and second electrical conduction conditions of the electromechanical switch, and the electromechanical switch characterized by upper and lower temperature thresholds, the first electrical conduction condition representing a temperature indicative of fire in the interior space of the tub and developed in response to a rise in the measured internal temperature above the upper temperature threshold and to a subsequent fall in the measured internal temperature to the lower temperature threshold, and the second electrical conduction condition representing a temperature indicative of absence of fire in the interior space of the tub and developed in response to the measured internal temperature when it is below the lower temperature threshold; and an electrical conductor electrically connecting the electromechanical switch and the valve actuator associated with the cold water valve outlet to produce and apply to the valve actuator, upon occurrence of the first switching state of the electromechanical switch, the valve control signal that actuates the cold water valve outlet and thereby causes flow of cold water through the fluid conduit and into the interior space of the tub to contain and extinguish a fire burning within the interior space of the tub.

15. The appliance of claim 14, further comprising a fire suppression fluid inlet to the interior space of the tub, the fire suppression fluid inlet positioned in the top portion of the tub, and which the fluid conduit includes a hose that connects the cold water valve outlet and the fire suppression fluid inlet to provide for the flow of cold water into the interior of the tub.

16. The appliance of claim 14, in which the electromechanical switch is a thermostat of a bimetal disk type.

17. The appliance of claim 14, further comprising:

clothes washer components combined with the vented clothes dryer appliance to form a combination washer-vented dryer appliance, in which the cold water valve outlet is one of multiple cold water valve outlets that are associated with different ones of valve actuators to which valve control signals are applied and are in fluid communication with the cold water inlet, and in which the fluid conduit is one of multiple separate fluid conduits that are configured for selective delivery of cold water to the interior space of the tub in response to the applied valve control signals.

18. The appliance of claim 14, further comprising:

clothes washer components combined with the vented clothes dryer appliance to form a combination washer-vented dryer appliance; and control circuitry operatively associated with the electrical conductor electrically connecting the electromechanical switch and the valve actuator associated with the cold water valve outlet, the control circuitry providing, while the electromechanical switch is in the second switching state, a cold water fill valve control signal for selective delivery of cold water along the fluid conduit to the interior space of the tub during a regular wash cycle.

19. The appliance of claim 14, in which the first electrical conduction condition and the second electrical conduction condition represent, respectively, a closed electrical circuit and an open electrical circuit.

* * * * *